US006446336B1

(12) United States Patent
Unger

(10) Patent No.: US 6,446,336 B1
(45) Date of Patent: Sep. 10, 2002

(54) HEAT EXCHANGER AND METHOD OF CONSTRUCTING SAME

(75) Inventor: Reuven Z-M Unger, Athens, OH (US)

(73) Assignee: Sunpower, Inc., Athens, OH (US)

( * ) Notice: Subject to any disclaimer, the term of this patent is extended or adjusted under 35 U.S.C. 154(b) by 0 days.

(21) Appl. No.: 09/389,786

(22) Filed: Sep. 3, 1999

(51) Int. Cl.[7] ..... B23P 15/26
(52) U.S. Cl. ..... 29/890.049; 29/890.046
(58) Field of Search ..... 29/890.036, 890.03, 29/890.046, 890.048, 890.049

(56) References Cited

U.S. PATENT DOCUMENTS 2,102,581 A * 12/1937 McNeish
2,643,863 A * 6/1953 Buschow
2,678,808 A * 5/1954 Gier, Jr.
3,002,729 A * 10/1961 Welsh
3,868,754 A * 3/1975 Kawano
4,348,794 A * 9/1982 Kim et al.
4,349,959 A * 9/1982 Bowden ..... 29/890.36
4,419,802 A * 12/1983 Riese

* cited by examiner

*Primary Examiner*—I Cuda Rosenbaum
(74) *Attorney, Agent, or Firm*—Jason H. Foster; Kremblas, Foster, Phillips & Pollick

(57) ABSTRACT

A method of forming a heat exchanger apparatus on a housing wall. The heat exchanger includes inner and outer annular rings. The rings have heat radiating, high surface area fins attached on oppositely facing surfaces. The inner ring has a radially outwardly facing surface that abuts the interior surface of the housing sidewall. The outer ring has a radially inwardly facing surface that abuts the exterior surface of the housing sidewall. When displaced longitudinally along the ring axes, which are coincidental, the sidewall is clampingly engaged therebetween, and an excellent thermal flow path is formed. Heat transferred into the inner fins from a working gas is conducted to the inner ring, through the sidewall, into the outer ring, then into the outer fins. Air impinging upon the outer fins absorbs the heat from the outer fins.

3 Claims, 5 Drawing Sheets

HEAT EXCHANGER AND METHOD OF CONSTRUCTING SAME

BACKGROUND OF THE INVENTION

1. Field of the Invention

This invention relates generally to heat exchangers, and more particularly to a heat exchanger for transferring heat between a fluid on the inside of a wall and a fluid at a different pressure on the outside of the wall, and a method of constructing such a heat exchanger.

2. Description of the Related Art

Heat exchangers transfer heat energy from one fluid to another. A common heat exchanger is an automobile radiator, in which heat is transferred from a warm water solution in the radiator to the cooler air. Heat is removed by passing the fluid, which can be a liquid or gas, through a thin-walled passage and directing air over the outside of the thin-walled passage. Gas molecules in the air impinge upon the walls of the passage, removing heat during contact.

In free piston Stirling cycle machines, there is a need to transfer heat from a gas on one side of a hermetically sealed housing to a fluid, such as environmental air, on the other. In free piston Stirling cycle cryocoolers in particular, a working gas, such as helium, within the housing is compressed, thereby raising its temperature. Heat is removed from the compression region of the housing as part of the process of absorbing heat in one region of the housing and rejecting it at another.

This heat pumping process requires the flow of heat energy through the housing wall. However, the most common housing wall material, stainless steel, is not a particularly good thermal conductor. A housing wall that is made thinner to transfer heat more rapidly cannot support the pressure within the housing.

Heat transfer in conventional Stirling cycle machines is assisted by attaching thin, highly thermally conductive fins to the inside and outside of the housing to promote heat transfer. The internal fins have high surface area upon which the working gas within the machine impinges, transferring heat energy to the fins. This heat energy flows through the housing wall to the cooler fins on the outside of the housing. Fluid coolant, such as ambient air, passes over the outer fins, removing heat.

Fins are conventionally attached by one of two methods. In one method, fins are brazed or soldered to the interior and exterior surfaces of the housing. In the second method, the housing is separated into two sections by cutting along a plane intersecting the housing. A fin structure is interposed between the two housing sections and brazed or soldered into place.

Two disadvantages to soldering or brazing fins to the housing are the high cost and the tendency brazing and soldering have to modify the metallurgical properties of both the housing and the fins. Disadvantages of interposing a fin structure include the high costs and metallurgical effects, and the possibility of leaks due to poor soldering or brazing.

Therefore, the need exists for an effective heat exchanger, and a method for forming the same, on a Stirling cycle machine in particular, and opposing sides of walls in general.

BRIEF SUMMARY OF THE INVENTION

The invention is a heat exchanger for transferring heat energy from one side of a housing wall to the opposite side. The invention also contemplates a method of constructing the heat exchanger. In the preferred embodiment, the housing wall is the housing of a free piston Stirling cycle machine, such as a cryocooler.

The apparatus includes an inner ring that seats against the inner surface of the housing. An outer ring seats against an outer surface of the housing. The rings are positioned coaxially and aligned longitudinally on opposite sides of the housing wall, forming a thermal energy conduction path from ring to ring. The rings also support the housing wall under the stress created by the pressure within the housing.

Heat transfer means, preferably thin, highly thermally conductive fins, are mounted to the opposing sides of the rings. The inner fins promote conduction of heat from the working gas within the housing to the inner ring. The heat is conducted through the housing sidewall to the outer ring. The heat is then conducted to the outer fins and then removed by gas circulating through gaps between the outer fins. This gas is environmental air in the embodiment contemplated, but could alternatively be a fluid coolant.

A method of forming the apparatus comprises seating the inner ring against the interior surface of the housing and then displacing it longitudinally to a predetermined longitudinal position. The outer ring is seated against the exterior surface of the housing and displaced longitudinally to the predetermined longitudinal position, preferably aligned with the inner ring on the opposite side of the sidewall. The relative temperatures of the rings can also be changed if desired.

The heat exchanger constructed has an interference fit between the abutting surfaces of the rings and the housing sidewall, thereby preventing relative movement of the rings and the housing sidewall. Furthermore, the high-contact area between the rings and the housing provides an excellent path for thermal energy conduction. There is no weakening of the metallurgical properties of the housing due to soldering or brazing, and in fact the heat exchanger strengthens the housing. There is no need to re-seal the housing sidewall due to interposition of a structure.

Figure 1:
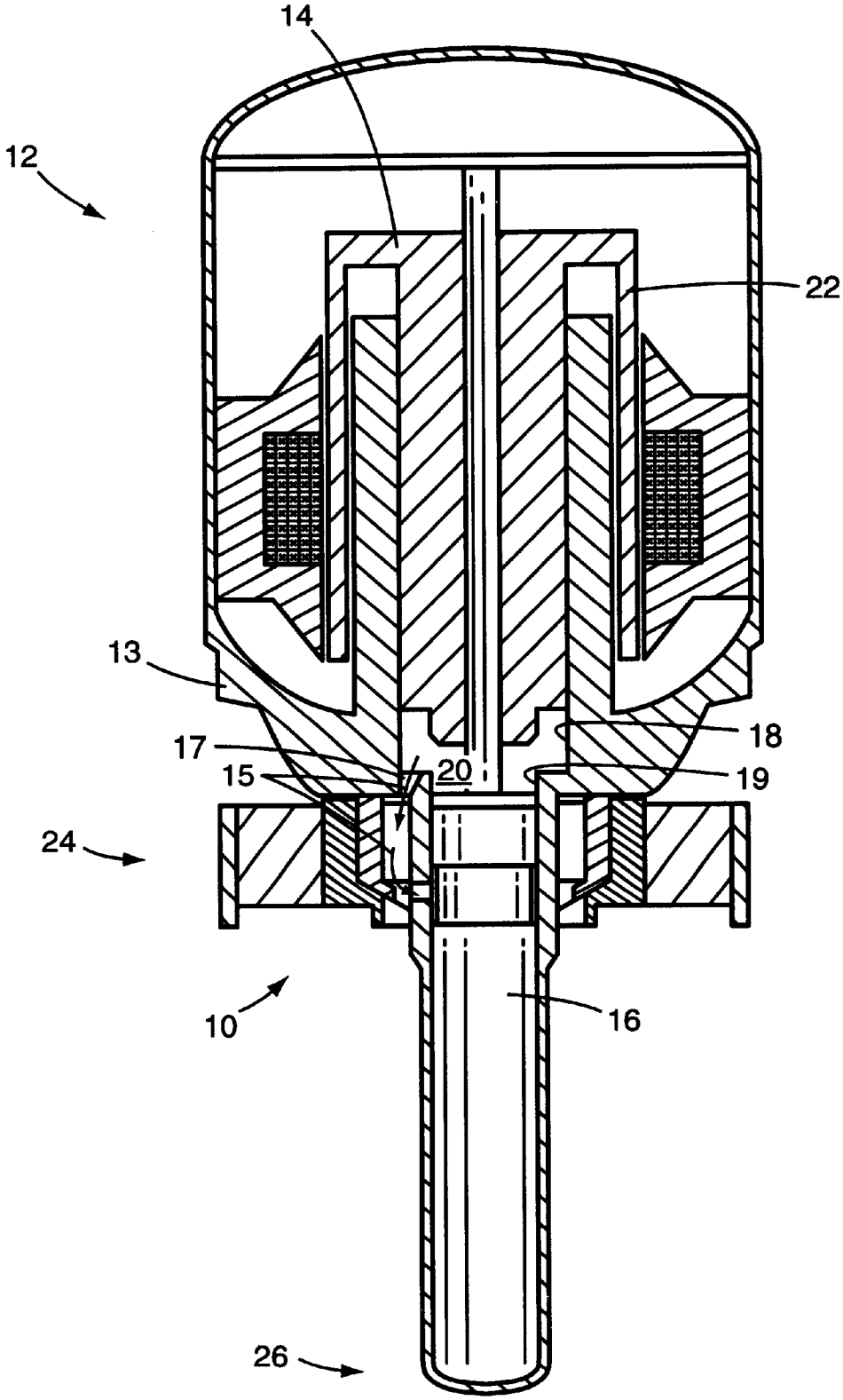
FIG. 1 is a side view in section illustrating the preferred embodiment of the present invention on the preferred free piston Stirling cycle cooler.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements, where such connection is recognized as being equivalent by those skilled in the art.

DETAILED DESCRIPTION OF THE INVENTION

The heat exchanger 10 of the present invention is shown in FIG. 1 in a free piston Stirling cycle cryocooler 12. However, as will become apparent to one of ordinary skill in the art from the description below, the invention can be used on any wall through which heat must be transferred, such as pipes, vessels and other structures.

The cryocooler 12 has a piston 14 that is slidably mounted in a cylindrical passage defined by the sidewall 18. A displacer 16 is slidably mounted in a cylindrical passage defined by the sidewall 19. The piston 14 is drivingly linked to an annular ring 22 to which magnets are mounted. The annular ring 22 is disposed within a gap in which a time-changing, alternating magnetic field is generated, driving the ring 22, and therefore the linked piston 14, in a reciprocating motion.

A working gas, such as helium, that is contained within the cryocooler 12 is compressed in the compression space 20 during a part of the reciprocation cycle of the piston 14, thereby raising the working gas temperature in the compression space 20. The heated working gas passes over the internal components of the heat exchanger 10 following the arrows 15 through apertures 17 in the housing 13. Some of the heat that is absorbed by the internal components from the working gas is conducted to the external components of the heat exchanger 10. Heat is removed by ambient air passing over the external components of the heat exchanger 10.

The cryocooler 12 pumps heat according to a known thermodynamic cycle from the cold end 26 where the working gas expands, to the compression space 20 where the working gas is compressed. The cold end 26 of the cryocooler 12 can thereby cool, for example, gaseous oxygen to condense and liquefy the oxygen, electronic devices, superconductors and any other device requiring cryogenic (less than 150K) temperatures.

Figure 3:
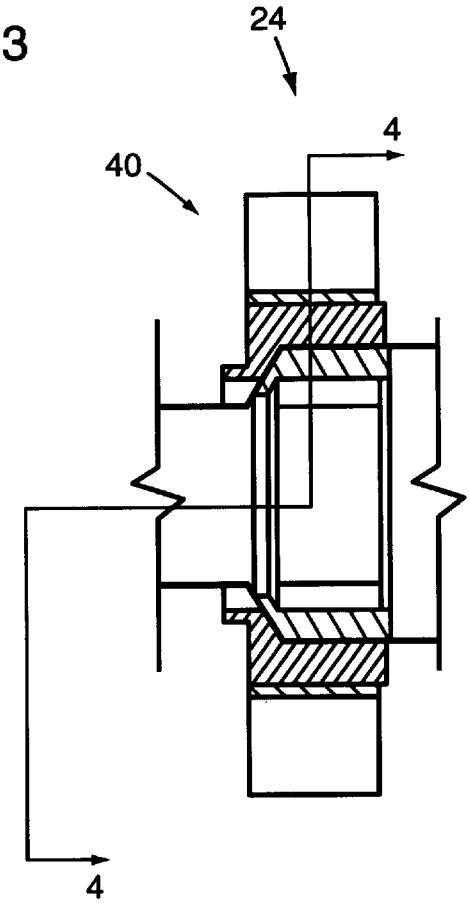
FIG. 3 is a side view in section illustrating the preferred heat exchanger and the relevant portion of the free piston Stirling cycle cryocooler of FIG. 1.
Figure 4:
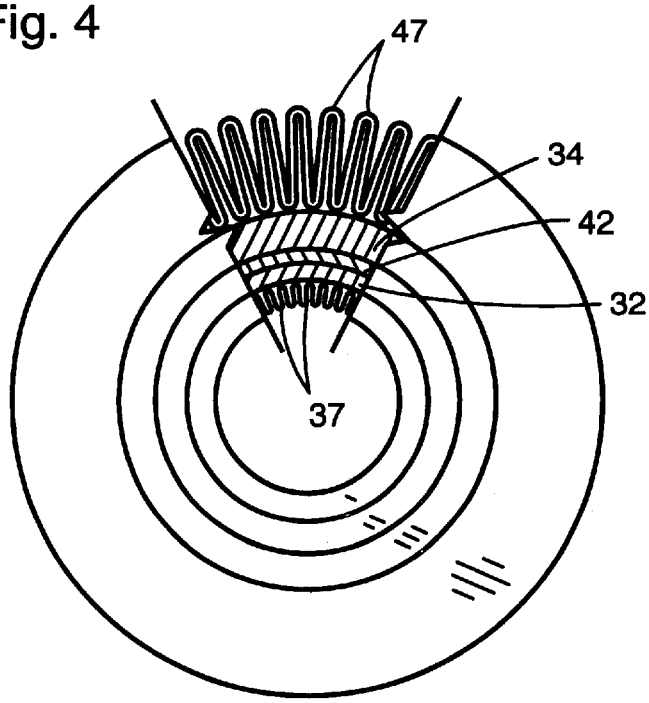
FIG. 4 is an end view in partial section along the line 4—4 of FIG. 3.
Figure 5:
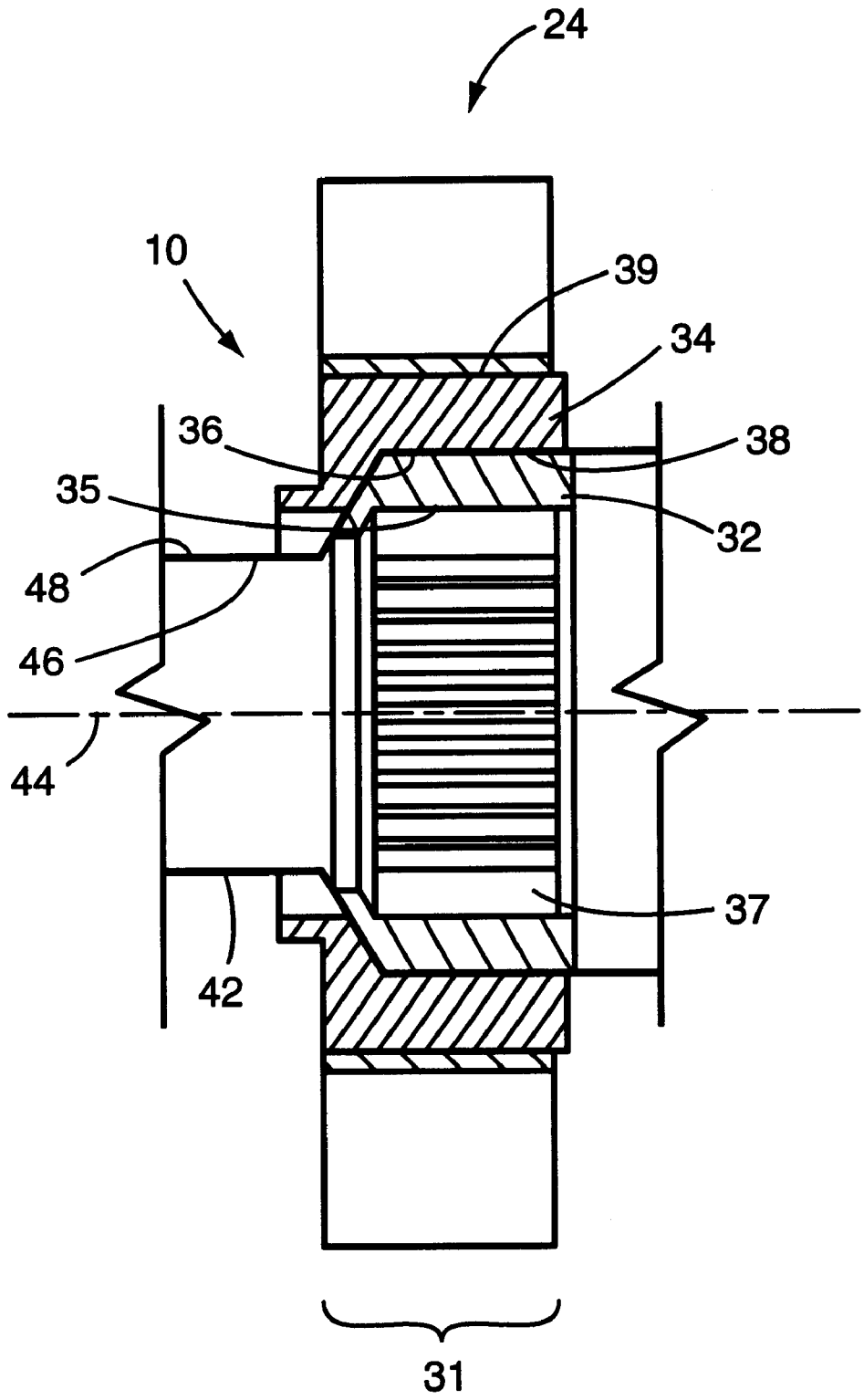
FIG. 5 is a magnified side view in section illustrating the preferred heat exchanger and the relevant portion of the free piston Stirling cycle cryocooler of FIG. 1.

The preferred heat exchanger 10, described briefly above and shown in more detail in FIGS. 3, 4 and 5, is mounted at the warmer region 24 of the cryocooler 24 to remove heat energy from the working gas in the compression space in that region.

Figure 2:
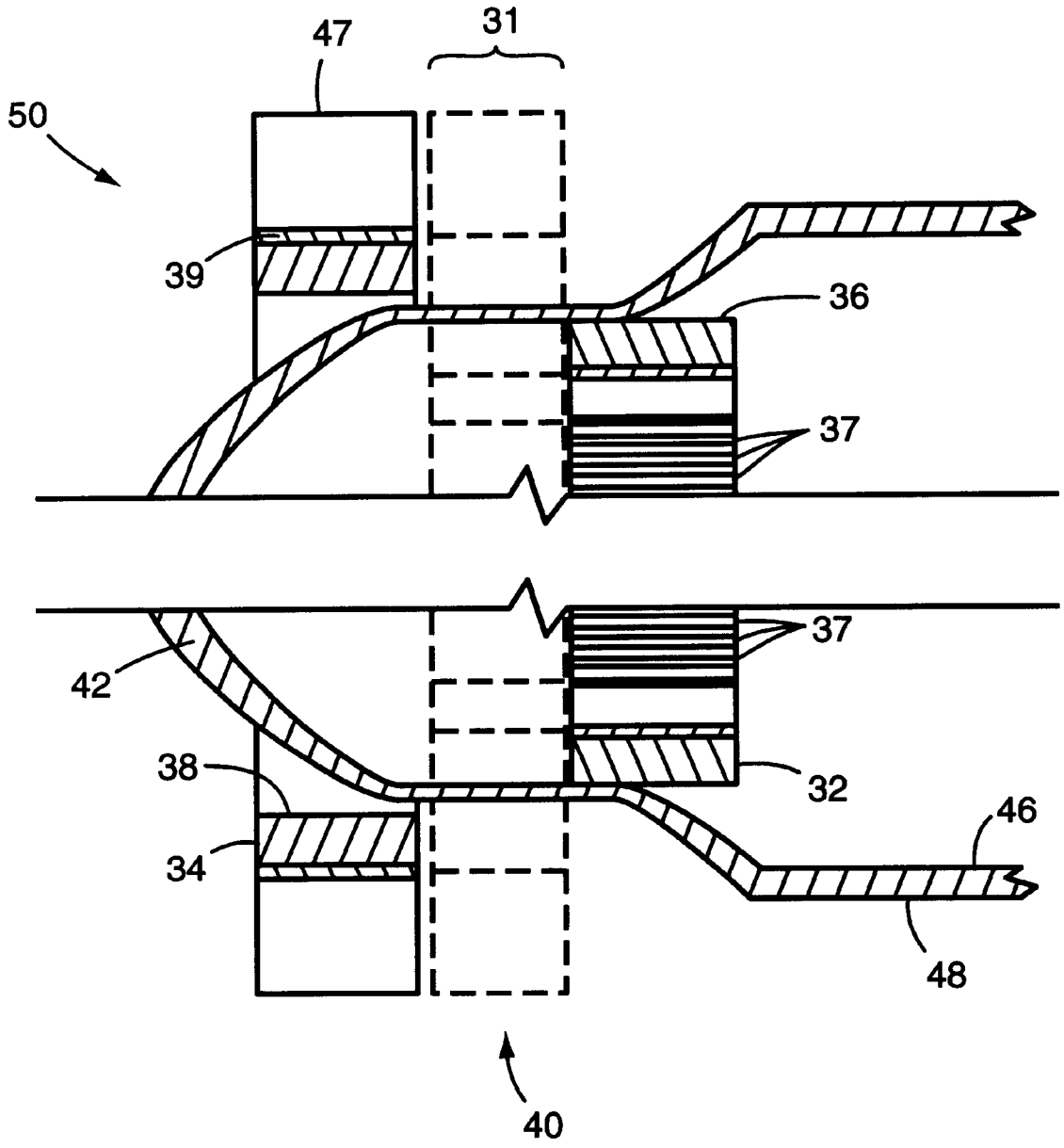
FIG. 2 is a side view in section of a schematic illustration of the preferred heat exchanger.

The cryocooler 12 has a sidewall 42 that is hermetically sealed to form a housing, only a portion of which is shown in FIGS. 3, 4 and 5. The sidewall 42 has an interior surface 46 and an exterior surface 48. The sidewall is very thin (approximately 0.3 mm), and around the compression space the housing diameter is large, increasing the stress in the sidewall 42 much more than an amount proportional to the increase in diameter. The heat exchanger supports this sidewall 42 where support is most needed. Next to the heat exchanger thicker sidewalls can be used as shown in FIG. 2, because heat transfer is not a substantial concern.

The heat exchanger 10 includes two main elements: an inner ring 32 and an outer ring 34. The inner ring 32 is a thick, preferably copper annulus having a radially outwardly facing surface 36 that, when positioned as shown in the heat exchanger region 31, seats against the interior surface 46 of the sidewall 42. The heat exchanger region 31 is the region of the housing sidewall 42 at which the inner ring 32 and the outer ring 34 are mounted in their preferred operable position shown in FIGS. 3 and 5.

Figure 6:
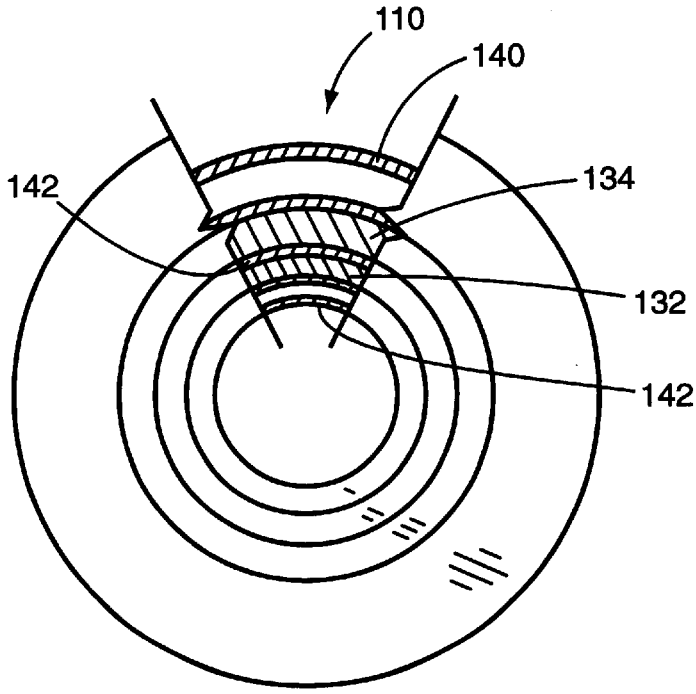
FIGS. 6 and 7 are end views in section illustrating alternative heat transfer means.
Figure 7:
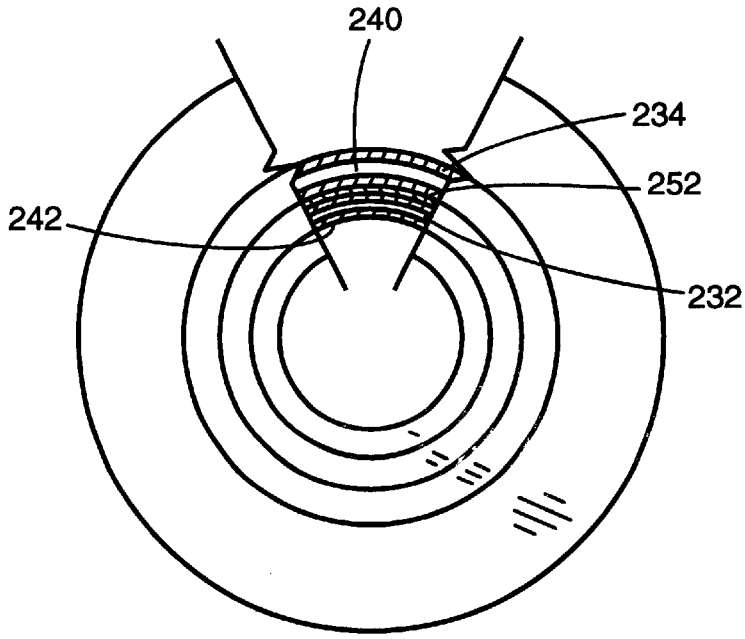

The inner ring 32 has a radially inwardly facing surface 35 to which a heat transfer means mounts. A heat transfer means is defined, for the purpose of the present invention, as a structure that facilitates the transfer of heat from a fluid to one of the rings or from one of the rings to a fluid. The preferred heat transfer means is a plurality of radially extending fins 37 shown in FIG. 4. Alternative heat transfer means include a thermally conductive tube, such as a copper tube, mounted to the surface of the ring, or mounted within the ring, through which a fluid, such as water or another liquid or a gas, flows to transfer heat energy to or from the ring. Examples of such alternatives are shown in FIGS. 6 and 7. Another alternative heat transfer means includes a heat sink, such as a very large piece of thermally conductive material.

The fins 37 are preferably made from a thin copper strip that is pleated into a plurality of panels with corners joining adjacent panels at opposite edges. The inner corners are mounted to the inwardly facing surface 35 of the inner ring 32 by brazing or soldering. Alternatively, the fins 37 could be integral with the inner ring 32 by forming the ring and fins of one piece of material, or by forming a larger ring and cutting away material to leave the ring and the fins.

Referring again to FIG. 5, the outer ring 34 is a thick, preferably copper annulus having a radially inwardly facing surface 38 that, when positioned in the heat exchanger region 31, seats against the exterior surface 48 of the sidewall 42. The outer ring 34 has a radially outwardly facing surface 39 to which a plurality of radially extending fins 47 attach as shown in FIG. 4. The fins 47 are preferably substantially similar in structure to the fins 37 formed on the inner ring 32, and function as the preferred heat transfer means mounted to the outer ring 34. The fins 47 are larger than the fins 37.

In the schematic illustration of FIG. 2, the inner ring 32 and the outer ring 34 are shown prior to being displaced along their axes to their final positions in the heat exchanger region 31. The rings 32 and 34 are first positioned as shown after being pre-assembled with the fins attached to the rings, and are subsequently forced into the positions shown in phantom.

The inner ring 32 is displaced to the left in FIG. 2 to the position shown in phantom, and the outer ring 34 is displaced to the right in FIG. 2 to the position shown in phantom. The order of ring displacement to the heat exchanger region 31 is not critical. It is critical, however, that the rings clampingly engage the sidewall 42 in a gap between them to provide a suitable thermal conduction path from the inner ring 32 to the outer ring 34. Such a clamping engagement is assured when the rings and sidewall have the dimensions described below. The dimensions described ensure a tight interference fit that provides thermal conduction between the abutting surfaces of the sidewall 42 and the rings 32 and 34.

There is a difference of approximately 0.504 mm in the diameter of the outwardly facing surface 36 of the inner ring 32 and the inwardly facing surface 38 of the outer ring 34. This difference forms an annular gap with a thickness of 0.252 mm if the rings 32 and 34 are placed one inside the other. The preferred thickness of the sidewall 42, which is positioned in that gap, is approximately 0.3 mm.

The difference in gap thickness and sidewall 42 thickness necessitates deformation of the inner ring 32, the outer ring 34, the sidewall 42 or a combination of some or all structures to position the structures as shown in FIG. 5. The inner and outer rings are preferably made of a copper alloy and the sidewall is made of stainless steel. Because copper alloys are generally more prone to deformation than stainless steel, the deformation occurs primarily in the rings 32 and 34, and most primarily in expansion of the inner diameter of the outer ring 34. Alternatively, the rings 32 and 34 can be heated, cooled or a combination to create a temperature difference to form a gap closer to or larger than 0.3 mm.

During operation the inner ring 32 is maintained at a higher temperature than the outer ring 34, which causes the inner ring 32 to expand more than the outer ring 34. This outward thermal expansion by the inner ring 32 against the mechanical inwardly directed force of the outer ring 34 ensures a clamping engagement of the sidewall 42 under all contemplated conditions and supports the sidewall 42 against the outwardly directed gas compression forces against the housing.

The stainless steel wall 42 has the ability to conform to the shape of the gap between the rings 32 and 34. Therefore, there can be a relatively loose fit between one ring and the wall's surface. However, because of the smaller gap between the facing surfaces of the rings, placing the second ring in place will cause the wall to conform essentially completely to the shape of the gap. This creates a substantial amount of ring to wall and wall to ring contact, providing excellent thermal conduction.

The sidewall 42 shown in FIG. 5 can be the preferred thickness of 0.3 mm because it is supported by the rings 32 and 34. The pressure in the compression space 20 increases cyclically during operation of the cooler, creating significant stress in the sidewall 42 surrounding the compression space 20. This stress could rupture a sidewall of the preferred thickness if it were not supported by the outer ring 34. If the sidewall 42 were made substantially thicker to support the stress, it would not be as effective at conducting heat out of the compression space 20. Therefore, the combination of the thin sidewall 42 supported by the heat exchanger 10 provides a desirable balance of rapid thermal conduction and strength.

As the cryocooler 12 utilizing the preferred heat exchanger operates, heat is pumped from the cold end 26 to the warmer region 24 by compression and expansion of the working gas. The heat must be transferred away from the working gas within the compression space 20 of the cryocooler through the heat exchanger to the environment. The fins 37 are positioned in the flow path of the working gas which is directed against the fins 37 by passing through apertures 17 formed all around the housing 13 just to the left of the leftward end of the sidewall 18 shown in FIG. 1. When the warmer working gas in the cryocooler 12 flows through the gaps between the fins 37 shown in FIG. 4, the gas transfers heat to the fins 37 via convection, in which heated gas molecules impinge upon the fins 37, conducting heat to the fins during the brief moment of contact. The working gas passes through the fins 37, into a regenerator within the displacer 16 and toward the cold end 26 where it expands.

The heat exchanger 10 forms a thermal conduction path that flows "downhill" from, the internal fins 37 to the external fins 47. The heat is conducted from the fins 37 to the cooler inner ring 32. From the inner ring 32, heat flows through the even cooler sidewall 22 toward the still cooler outer ring 34. Finally, heat is conducted to the coolest part of the heat exchanger, the fins 47. Atmospheric gas molecules impinging upon the fins 47 remove heat energy via convection, preferably to the atmosphere.

The heat exchanger could, alternatively, be used to transfer heat energy into a Stirling cycle cryocooler, for example at the cooler end 26. Of course, the heat exchanger of the present invention could also be used on Stirling cycle engines, coolers and other non-Stirling cycle machines.

Alternative heat transfer means are shown in FIG. 6 and 7. The outer ring 134 and the inner ring 132 of the heat exchanger 110 of FIG. 6 form an interference fit with the sidewall 142 as in the preferred embodiment. The outer ring 134 has a fluid tube 140 that is mounted to the radially outwardly facing surface of the outer ring 134 by conventional mounting, such as soldering. The fluid tube 142 is mounted to the radially inwardly facing surface of the inner ring 132 by conventional mounting, such as soldering.

The fluid tube 142 transfers heat to the ring 132 from the fluid within the tube, and the ring 134 transfers heat to the fluid in the tube 140. The tubes could, alternatively, be formed as passages within the rings, as in the heat exchanger 210 shown in FIG. 7 in which the rings 232 and 234 form an interference fit with the sidewall 252. The fluid passages 240 and 242 are formed within the rings 234 and 232, respectively, and fluid flows therethrough to transfer heat from the fluid to a ring or to the fluid from a ring.

While certain preferred embodiments of the present invention have been disclosed in detail, it is to be understood that various modifications may be adopted without departing from the spirit of the invention or scope of the following claims.

What is claimed is:

1. A method of forming a heat exchanger at a predetermined heat exchanger region on a wall having an interior surface and an exterior surface, the method comprising:

(a) aligning a radially inwardly facing surface of an annular, outer ring coaxially with the exterior surface of the wall, the outer ring having a connected heat transfer means;

(b) displacing the outer ring along an outer ring axis until the radially inwardly facing surface seats against the exterior surface of the wall at the predetermined heat exchanger region;

(c) aligning a radially outwardly facing surface of an annular, inner ring coaxially with the interior surface of the wall, the inner ring having a connected heat transfer means; and (d) displacing the inner ring along an inner ring axis until the radially outwardly facing surface seats against the interior surface of the wall at the predetermined heat exchanger region and on an opposite side of the wall as the outer ring, thereby clampingly retaining the wall between the radially outwardly facing surface of the inner ring and the radially inwardly facing surface of the outer ring.

2. A method in accordance with claim 1, wherein the inner ring is displaced in a first direction, and the outer ring is displaced in a second, opposite direction.

3. A method in accordance with claim 1, further comprising creating a temperature difference between the rings.

* * * * *